US012420900B1

(12) United States Patent
Przybyl et al.

(10) Patent No.: US 12,420,900 B1
(45) Date of Patent: Sep. 23, 2025

(54) MARINE DRIVES HAVING A RETAINER FOR FLEXIBLE RIGGING CONNECTORS

(71) Applicant: Brunswick Corporation, Mettawa, IL (US)

(72) Inventors: Andrew J. Przybyl, Berlin, WI (US); Kenneth E. Peterson, Waupun, WI (US); Derek J. Fletcher, Oshkosh, WI (US); Phillip J. Niemann, Howards Grove, WI (US)

(73) Assignee: Brunswick Corporation, Mettawa, IL (US)

( * ) Notice: Subject to any disclaimer, the term of this patent is extended or adjusted under 35 U.S.C. 154(b) by 498 days.

(21) Appl. No.: 18/092,772

(22) Filed: Jan. 3, 2023

(51) Int. Cl.
*B63H 20/12* (2006.01)

(52) U.S. Cl.
CPC ..... *B63H 20/12* (2013.01)

(58) Field of Classification Search
CPC ..... B63H 20/12
See application file for complete search history.

(56) References Cited

U.S. PATENT DOCUMENTS

| | | | | |
|---|---|---|---|---|
| 2,703,989 | A * | 3/1955 | Schroeder | B63H 20/20 74/30 |
| 4,375,356 | A | 3/1983 | Stevens | |
| 4,739,801 | A | 4/1988 | Kimura | |
| 4,969,847 | A | 11/1990 | Curtis et al. | |
| 5,007,858 | A | 4/1991 | Daly et al. | |
| 5,054,944 | A | 10/1991 | Matsuyama | |
| 5,078,629 | A * | 1/1992 | Mondek | F02B 61/045 123/195 C |
| 5,556,310 | A | 9/1996 | Gandarillas | |
| 5,637,021 | A | 6/1997 | Watanabe | |
| 6,034,326 | A | 3/2000 | Jorgensen | |
| 6,093,066 | A | 7/2000 | Isogawa | |
| 6,257,940 | B1 | 7/2001 | Dunham et al. | |
| 6,364,724 | B1 | 4/2002 | Nozawa et al. | |
| 6,387,002 | B1 | 5/2002 | Blase | |
| 6,902,450 | B2 | 6/2005 | Ohtsuki et al. | |
| 6,960,108 | B1 | 11/2005 | Jaszewski et al. | |
| 7,104,856 | B1 | 9/2006 | Krupp et al. | |
| 7,214,113 | B2 | 5/2007 | Kojima | |

(Continued)

FOREIGN PATENT DOCUMENTS

JP H10250688 A 9/1998

OTHER PUBLICATIONS

Unpublished U.S. Appl. No. 17/880,987, filed Aug. 4, 2022.

(Continued)

*Primary Examiner* — Stephen P Avila
(74) *Attorney, Agent, or Firm* — Andrus Intellectual Property Law, LLP

(57) ABSTRACT

A marine drive is for propelling a marine vessel in water. The marine drive has a cowling defining a cowling interior, a steering arm extending forwardly from the marine drive, the steering arm configured for steering of the marine drive about a steering axis, a flexible rigging connector extending forwardly from the cowling interior to a location in the marine vessel, and a retainer on the steering arm which retains the flexible rigging connector in position relative to the steering arm such that steering of the marine drive about the steering axis also steers the retainer and the flexible rigging connector about the steering axis.

20 Claims, 7 Drawing Sheets

(56) References Cited

U.S. PATENT DOCUMENTS

| | | | | |
|---|---|---|---|---|
| 7,442,104 | B2 | 10/2008 | Okabe | |
| 7,704,109 | B2 | 4/2010 | Arai et al. | |
| 7,883,385 | B2 | 2/2011 | Sakamoto | |
| 8,658,904 | B2 | 2/2014 | Naganuma et al. | |
| 8,858,280 | B1 | 10/2014 | Wiegele et al. | |
| 9,365,277 | B2 | 6/2016 | Skrzypchak et al. | |
| 9,493,221 | B2 | 11/2016 | Cordell | |
| 9,764,813 | B1 | 9/2017 | Zarembka et al. | |
| 9,783,278 | B1 | 10/2017 | Dannenberg et al. | |
| 9,789,945 | B1 | 10/2017 | Vaninetti et al. | |
| 10,017,136 | B1 * | 7/2018 | Waisanen ..... | B63H 20/32 |
| 10,046,842 | B2 | 8/2018 | Mizutani | |
| 10,202,180 | B1 | 2/2019 | Amerling et al. | |
| 10,246,173 | B1 | 4/2019 | Ingebritson | |
| 10,286,989 | B1 | 5/2019 | Amerling et al. | |
| 10,696,367 | B1 | 6/2020 | Ingebritson et al. | |
| 10,710,691 | B2 | 7/2020 | Amerling et al. | |
| 11,046,405 | B1 | 6/2021 | Groeschel et al. | |
| 11,066,140 | B1 | 7/2021 | Huffer et al. | |
| 11,084,563 | B1 | 8/2021 | Pielow et al. | |
| 11,377,186 | B1 | 7/2022 | Ahlswede et al. | |
| 2004/0083655 | A1 | 5/2004 | Suzuki | |
| 2004/0226737 | A1 | 11/2004 | Ide et al. | |
| 2011/0170733 | A1 | 7/2011 | Aase | |
| 2018/0170501 | A1 | 6/2018 | Gai et al. | |
| 2024/0253912 | A1 | 8/2024 | Tanaka | |

OTHER PUBLICATIONS

Unpublished U.S. Appl. No. 17/585,214, filed Jan. 26, 2022.
Navy Series Electric Outboard/ePropulsion, https://www.epropulsion.com/navy/?wpmeteordisable=1, accessed Aug. 10, 2022.
Outboard—Cruise 10.0 T—Torqeed, https://www.torqeedo.com/us/en-us/products/outboards/cruise/cruise-10.0-t/M-1243-20.html, accessed Aug. 10, 2022.
Inventor's Declaration of Prior Art, Dec. 2022.

* cited by examiner

MARINE DRIVES HAVING A RETAINER FOR FLEXIBLE RIGGING CONNECTORS

FIELD

The present disclosure relates to marine drives and particularly to marine drives having flexible rigging connectors.

BACKGROUND

The following U.S. Patents provide additional background and are incorporated herein by reference.

U.S. Pat. No. 11,377,186 discloses an apparatus for operably connecting a marine drive to a marine vessel. A transom bracket is configured for fixed attachment to the marine vessel and for attachment to the marine drive such that the marine drive is trimmable up and down relative to the marine vessel about a trim axis. The transom bracket has a sidewall with a rigging opening through which at least one elongated rigging member extends for operably connecting the marine drive to the marine vessel, wherein the rigging opening is located along the trim axis. The rigging device has an elbow conduit with an inlet end and an outlet end, wherein the outlet end is positionable into a plurality of clock positions relative to the inlet end.

U.S. Pat. No. 11,046,405 discloses a rigging hose housing provided to couple a rigging hose to a marine vessel. The rigging hose housing includes a radial mounting plate, an outer cylindrical wall extending perpendicularly from the radial mounting plate a first height above a bottom surface of the radial mounting plate, an inner cylindrical wall extending perpendicularly from the radial mounting plate a second height above the bottom surface of the radial mounting plate, and a gutter formed between the inner cylindrical wall and the outer cylindrical wall. The gutter terminates in a drain hole formed in the outer cylindrical wall. The drain hole is configured to permit the expulsion of fluid collected in the gutter from the rigging hose housing.

U.S. Pat. No. 10,710,691 discloses a marine drive including an engine and a cowl having first and second cowl portions. The first cowl portion is movable with respect to the second cowl portion into an open position in which the engine is manually accessible and a closed position in which the engine is enclosed, and a rigging port in the second cowl portion. The rigging port provides a passageway for rigging connectors extending from the engine to a component located remotely from the engine. A rigging opening provides manual access to the rigging connectors and the engine, including when the first cowl portion is in the closed position. A removable access door covers the rigging opening and prevents manual access to the engine and rigging connectors via the rigging opening. The removable access door is fastened to the second cowl portion by a removable fastener that is hidden from view.

U.S. Pat. No. 10,202,180 discloses an outboard motor including an engine coupled in torque-transmitting relationship with a propulsor via a driveshaft. A protective covering for the outboard motor includes a cowl that houses the engine within a closed interior thereof. An opening in an outer surface of the cowl provides access to the closed interior. A rigging tray can be inserted through the opening to a retracted position, in which a majority of the rigging tray is within the closed interior. A plurality of electrical lines extends from the engine and into the rigging tray from a first end thereof. Each electrical line in the plurality of electrical lines terminates in the rigging tray at a respective one of a plurality of electrical connectors. A second end of the rigging tray receives a complementary plurality of vessel electrical lines for connection to the plurality of engine electrical lines via the plurality of electrical connectors.

U.S. Pat. No. 10,017,136 discloses an outboard motor which can be coupled to a transom of a marine vessel via a rigging system. The rigging system includes a plurality of engine-sourced lines extending from an engine of the outboard motor, through an aperture in the motor housing, and to the marine vessel. A protective tube surrounds the plurality of engine-sourced lines and has a first end coupled to the motor housing and a second end coupled to the marine vessel. A rigging center is located aboard the marine vessel and holds distal ends of each of the engine-sourced lines. A plurality of connectors is provided on the distal ends of the engine-sourced lines. At the rigging center, each engine-sourced line is configured to be coupled, via a respective connector, to a corresponding vessel-sourced line. The vessel-sourced lines are in turn connected to respective engine-related devices aboard the marine vessel.

U.S. Pat. No. 7,104,856 discloses a rigging apparatus provided for an outboard motor in which an attachment member is shaped to be rigidly attached to a housing structure, or cowl, of an outboard motor, without the need for additional hardware such as clamps, brackets, or screws. The attachment member is shaped to receive a threaded sleeve in threaded association therewith so that hoses, wires, and cables can be protected within the threaded sleeve. An attachment member of the rigging apparatus is made to be asymmetrical to avoid improper assembly into an opening of the housing structure of an outboard motor.

SUMMARY

This Summary is provided to introduce a selection of concepts which are further described herein below in the Detailed Description. This Summary is not intended to identify key or essential features of the claimed subject matter, nor is it intended to be used as an aid in limiting scope of the claimed subject matter.

In non-limiting examples disclosed herein, a marine drive is for propelling a marine vessel in water. The marine drive has a cowling defining a cowling interior, a steering arm extending forwardly from the marine drive, the steering arm configured for steering of the marine drive about a steering axis, a flexible rigging connector extending forwardly from the cowling interior to a location in the marine vessel, and a retainer on the steering arm which retains the flexible rigging connector in position relative to the steering arm such that steering of the marine drive about the steering axis also steers the retainer and the flexible rigging connector about the steering axis.

In some examples, the retainer may be located on top of the steering arm. The retainer may clamp the flexible rigging connector in place relative to the steering arm. The retainer may include a rib frictionally engaged with the flexible rigging connector to inhibit axial movement of the flexible rigging connector relative to the retainer. The flexible rigging connector may have an outer diameter, and wherein the retainer surrounds the outer diameter. The flexible rigging connector may extend through the retainer. The steering arm may include a body which extends forwardly from a supporting frame of the marine drive and an extension bracket which extends forwardly from the body, and wherein the retainer may be mounted on the extension bracket.

In some examples, the retainer may include a tray which is coupled to the steering arm and a cap on the tray, and wherein the flexible rigging connector is clamped between the cap and the tray. The cap may be fastened to the tray by a fastener, and wherein fastening the fastener clamps the flexible rigging connector between the cap and the tray. The tray and cap may together define a channel through which the flexible rigging connector extends. The retainer may include a rib in the channel which is frictionally engaged with the flexible rigging connector to inhibit axial movement of the flexible rigging connector relative to the retainer. The rib may be an annular rib. The rib may be one of a plurality of ribs which are axially spaced apart.

In some examples, the marine drive may include a steering link coupled to the steering arm, wherein movement of the steering link steers the marine drive relative to the steering axis. The steering link may be pivotably coupled to the steering arm at a pivot joint such that lateral movement of the steering link causes steering movement of the steering arm relative to the steering axis. The retainer may include a cutaway which accommodates pivoting movement of the steering link relative to the steering arm.

In some examples, the flexible rigging connector may be one of first and second flexible rigging connectors and wherein the retainer retains the first and second flexible rigging connectors in position relative to the steering arm such that steering of the marine drive about the steering axis also steers the retainer and the first and second flexible rigging connectors about the steering axis. The first and second flexible rigging connectors may be laterally adjacent to each other. The retainer may include a tray which is coupled to the steering arm and a cap on the tray, and the first and second flexible rigging connectors may be clamped between the cap and the tray. The tray and cap may together define first and second channels through which the first and second flexible rigging connectors extend and may further include an annular rib in each of the first and second channels which are frictionally engaged with the first and second flexible rigging connectors respectively, to inhibit axial movement of the first and second flexible rigging connectors relative to the retainer.

BRIEF DESCRIPTION OF THE DRAWINGS

Examples are described with reference to the following drawing figures.

DETAILED DESCRIPTION

During research and development in the field of marine drives, the present inventors determined that rigging connectors extending from a marine drive to a marine vessel are often subject to bending and/or abrasion which may damage the rigging connectors over extended periods of time. Typical rigging members may include but are not limited to hoses, wires, cables, and/or the like, which extend between a marine vessel and a marine drive coupled to the vessel's transom. For example, the electrical system of the marine drive often includes a variety of electrical control and power components. A wiring harness may extend between the marine drive and a helm of the marine vessel. The wiring harness may contain electrical lines that relay digital steering, throttle, and shift commands between the helm and the marine drive. Electrical lines relaying other types of control signals may also be present. Additionally, battery cables may extend between one or more batteries housed within the vessel and terminals provided on the outboard motor. Moreover, in marine drives having an engine, one or more fuel lines may supply fuel to the engine from a fuel tank housed within the vessel. Many marine drives, such as outboard motors, have a tiller for steering. Because the tiller and associated steering arm are usually centered on the marine drive, rigging connectors may need to curve around the tiller and steering arm, which may cause significant movement of the rigging connectors when turning the marine drive. Repetitive movement may cause the connectors to rub against the transom bracket, the transom itself, or other parts of the marine vessel or marine drive support structure resulting in chafing of the connectors. Moreover, lengthy rigging connectors extending between the marine drive and the marine vessel can affect the styling of the marine drive and can otherwise be inconvenient for a number of reasons. Through research and experimentation, the present inventors determined it would be advantageous to provide features which support rigging connectors extending between the marine drive and the vessel such that the rigging connectors do not move/translate when the drive is steered from side to side and trimmed up and down. The present disclosure is a result of the present inventor's efforts in this regard.

Figure 1:
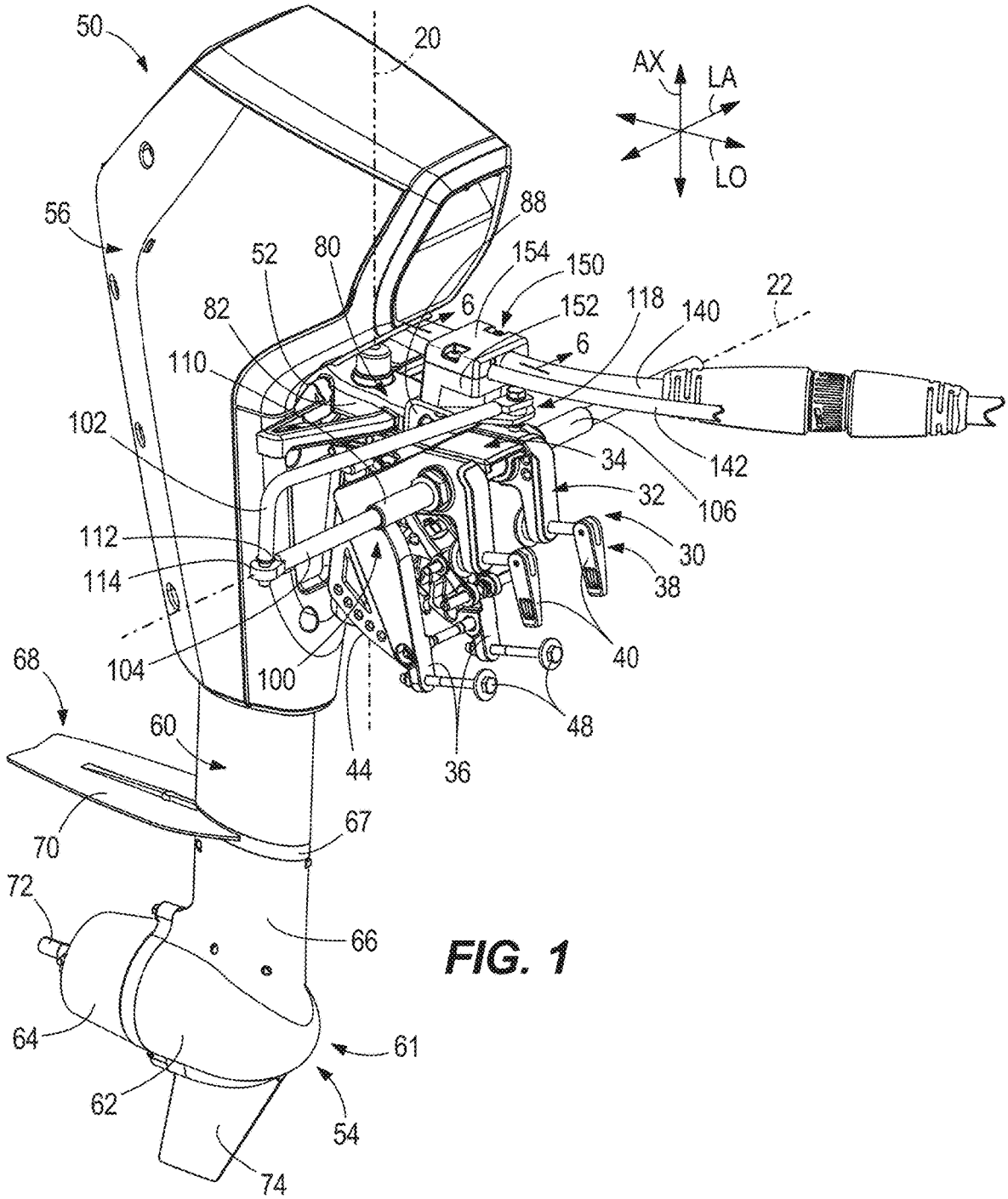
FIG. 1 is a starboard side perspective view of a marine drive configured to be mounted on the transom of a marine vessel and including a retainer for retaining rigging connectors in position relative to the marine drive.
Figure 2:
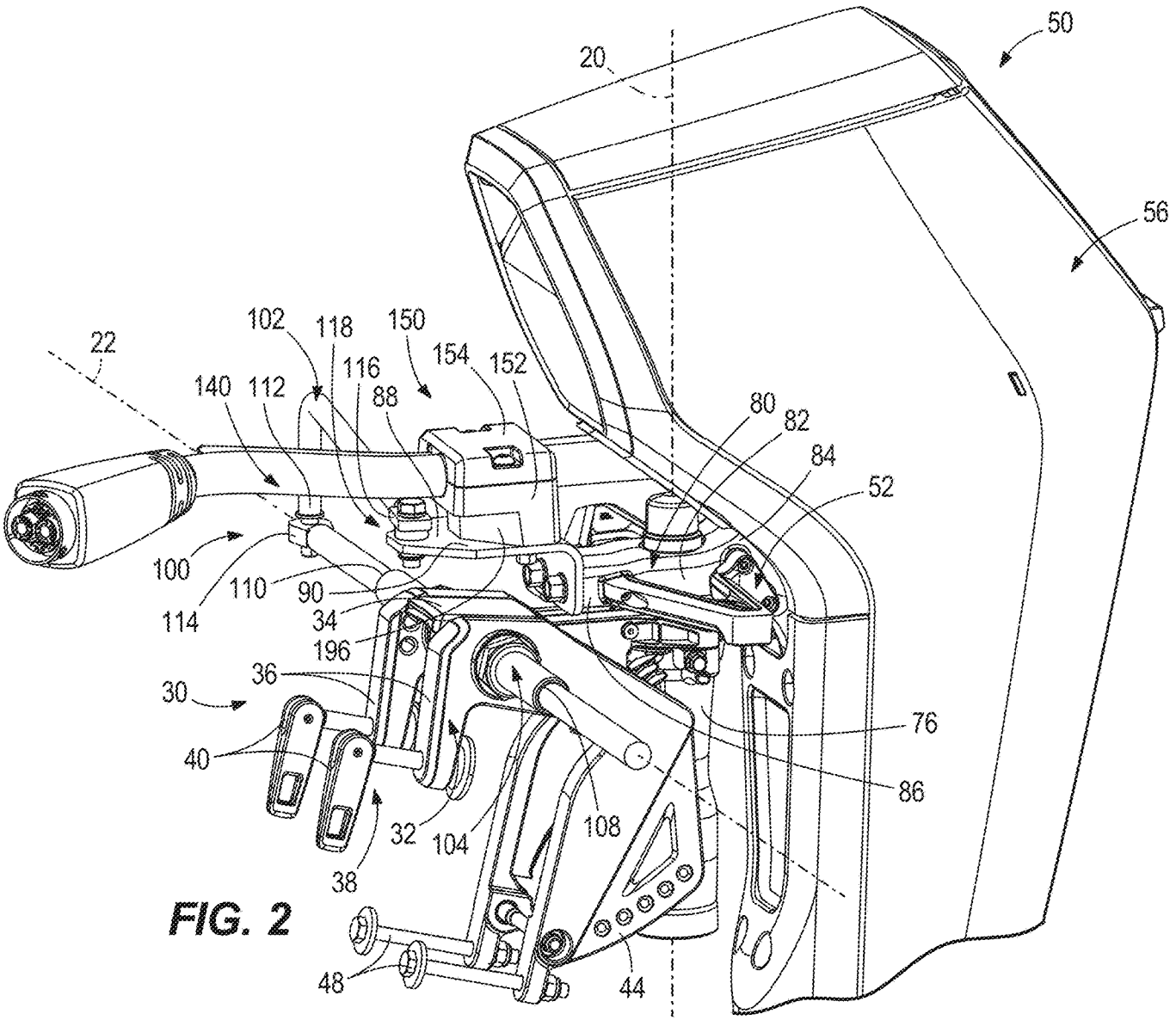
FIG. 2 is a port side perspective view of the marine drive of FIG. 1.

FIGS. 1 and 2 depicts a marine drive 50 for propelling a marine vessel in a body of water. In the illustrated embodiment, the marine drive 50 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO. A transom bracket assembly 30 supports the marine drive 50 on the transom (not shown) of the marine vessel such that the marine drive 50 is trimmable up and down relative to the transom bracket assembly 30, including in non-limiting examples wherein the marine drive 50 is raised completely out of the water.

Referring to FIG. 1. the marine drive 50 includes a supporting frame 52 for rigidly supporting the various components of the marine drive 50 with respect to the marine vessel The supporting frame 52 has body 53 (see FIG. 3) and a support leg extending downwardly from the bottom of the body. A cowling 56 is supported on the supporting frame 52 and defines a cowling interior 58 (see FIG. 3) in which a portion of the supporting frame 52 is enclosed and various components of the marine drive 50 are disposed. A lower end of the support leg is coupled to a lower unit 61 of the marine drive 50, which generally includes a torpedo housing 54, a stem 66, an extension leg 60, and an anti-ventilation plate 68 disposed between the stem 66 and the extension leg 60. The anti-ventilation plate 68 has a head 67 positioned between the extension leg 60 and the stem 66 and includes a generally flat anti-cavitation plate 70 that extends rearwardly from the extension leg 60.

The torpedo housing 54 has a front housing portion 62 and a rear housing portion 64 which are mated together and define a watertight lower housing cavity for containing a motor (not shown) and related componentry. The front housing portion 62 has a nosecone with a smooth outer surface which transitions to the upwardly extending stem 66 and a downwardly extending skeg 74. A conventional propulsor (not shown) is mounted on the outer end of a propulsor shaft 72 extending from the torpedo housing 54 such that rotation of the propulsor shaft by the motor causes rotation of the propulsor, which in turn generates a thrust force for propelling the marine vessel in water. It should be understood that the various components described above are exemplary and could vary from what is shown.

Referring to FIGS. 1 and 2, the marine drive 50 is coupled to the transom of a marine vessel by a transom bracket assembly 30, which in the illustrated example includes a transom bracket 32 configured to be fixed to the transom and a swivel bracket 34 pivotably coupled to the transom bracket 32. The transom bracket 32 has a pair of C-shaped arms 36 which fit over the top of the transom and a pair of threaded, plunger-style clamps 38 which clamp the C-shaped arms 36 to the transom. Rotation of handles 40 in one direction clamps the transom between the C-shaped arms 36 and plunger-style clamps 38. Rotation of the handles 40 in the opposite direction frees the C-shaped arms 36 for removal from the transom. In some embodiments, the transom bracket 32 is additionally or alternatively fixed to the transom by at least one fastener 48.

The swivel bracket 34 is pivotable with respect to the C-shaped arms 36 about a pivot shaft that laterally extends through the forward upper ends of the C-shaped arms 36, thereby defining a trim axis 22. Pivoting of the swivel bracket 34 about the pivot shaft trims the marine drive 50 relative to the marine vessel, for example out of and/or back into the body of water in which the marine vessel is operated. A selector bracket 44 having holes is provided on at least one of the C-shaped arms 36. Holes respectively become aligned with a corresponding mounting hole on the swivel bracket 34 at different selectable trim positions for the marine drive 50. A selector pin (not shown) can be manually inserted into the aligned holes to thereby lock the marine drive 50 in place with respect to the trim axis 22.

Figure 4:
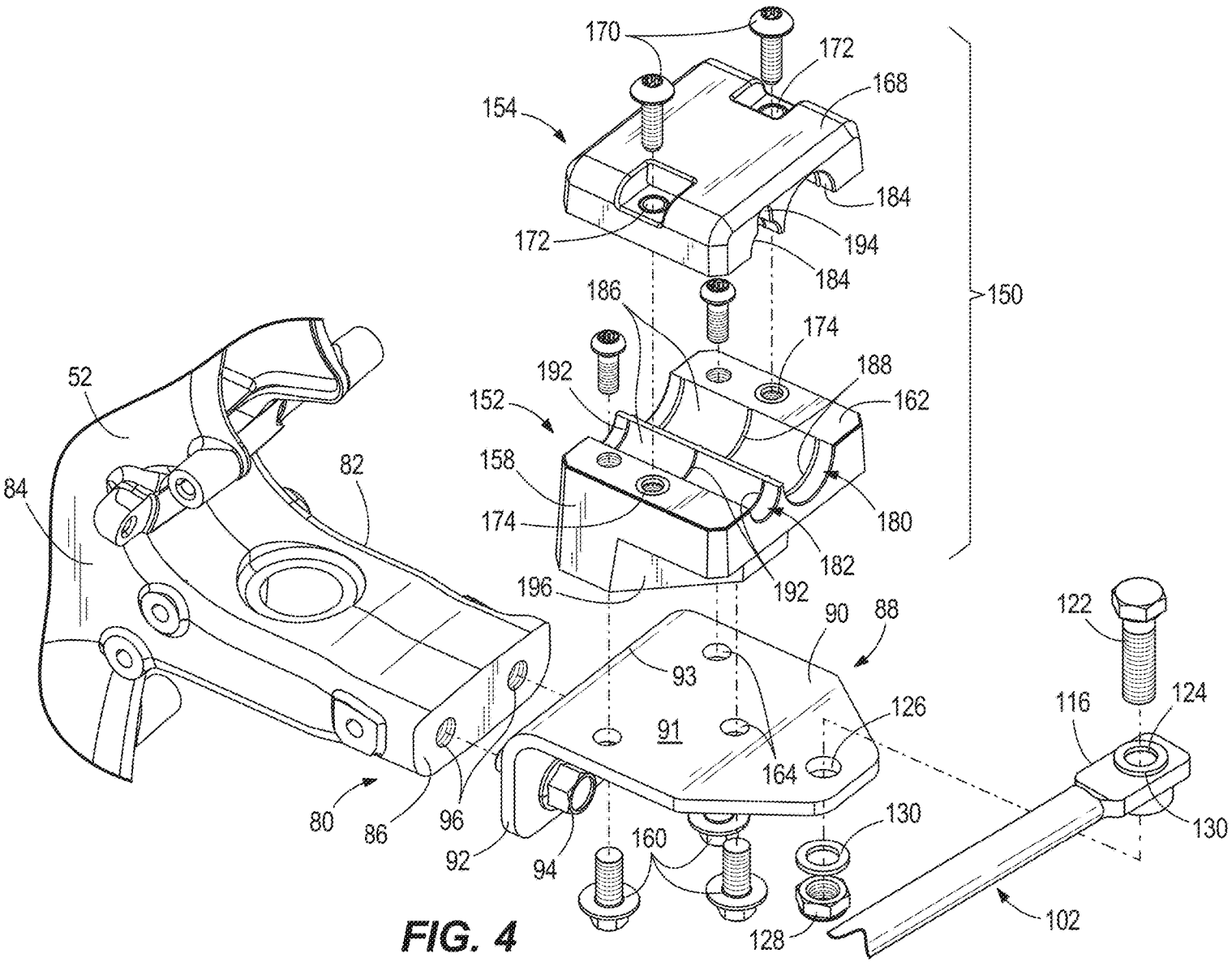
FIG. 4 is an exploded perspective view of the steering arm and retainer of the marine drive of FIG. 3.

The marine drive 50 is supported on the swivel bracket 34 by a steering arm 80, which extends forwardly from the body 82 of the supporting frame 52 of the marine drive 50, generally along the midsection of the marine drive 50. Referring to FIG. 4, the steering arm 80 includes a body 82 and an extension bracket 88. The body 82 of the steering arm 80 extends forwardly from a first end 84, which is connected to the supporting frame 52, to an opposite second end 86. The extension bracket 88 includes a generally planar supporting surface 90 and an attachment portion 92 that extends downwardly from a back end 93 of the supporting surface 90. The extension bracket 88 is coupled to the second end 86 of the body 82 with at least one fastener 94 that extends through the attachment portion 92 to engage a corresponding threaded hole 96 formed into the second end 86. Some embodiments may include an extension bracket 88 which is integrally formed with the body 82.

Referring to FIGS. 1 and 2, a swivel tube assembly 77 (top portion shown in FIG. 3) extends transversely from the body 82 of the steering arm 80 and is received in a swivel cylinder 76 of the swivel bracket 34. The steering arm 80 is configured for steering of the marine drive 50 about a steering axis 20, which is defined by the swivel tube assembly 77 and swivel cylinder 76. In the illustrated embodiments, for example, the marine drive 50 is configured with a steering system 100 that can be controlled from a remote location on the marine vessel, such as at the helm of the marine vessel and/or any other location on the marine vessel.

Figure 3:
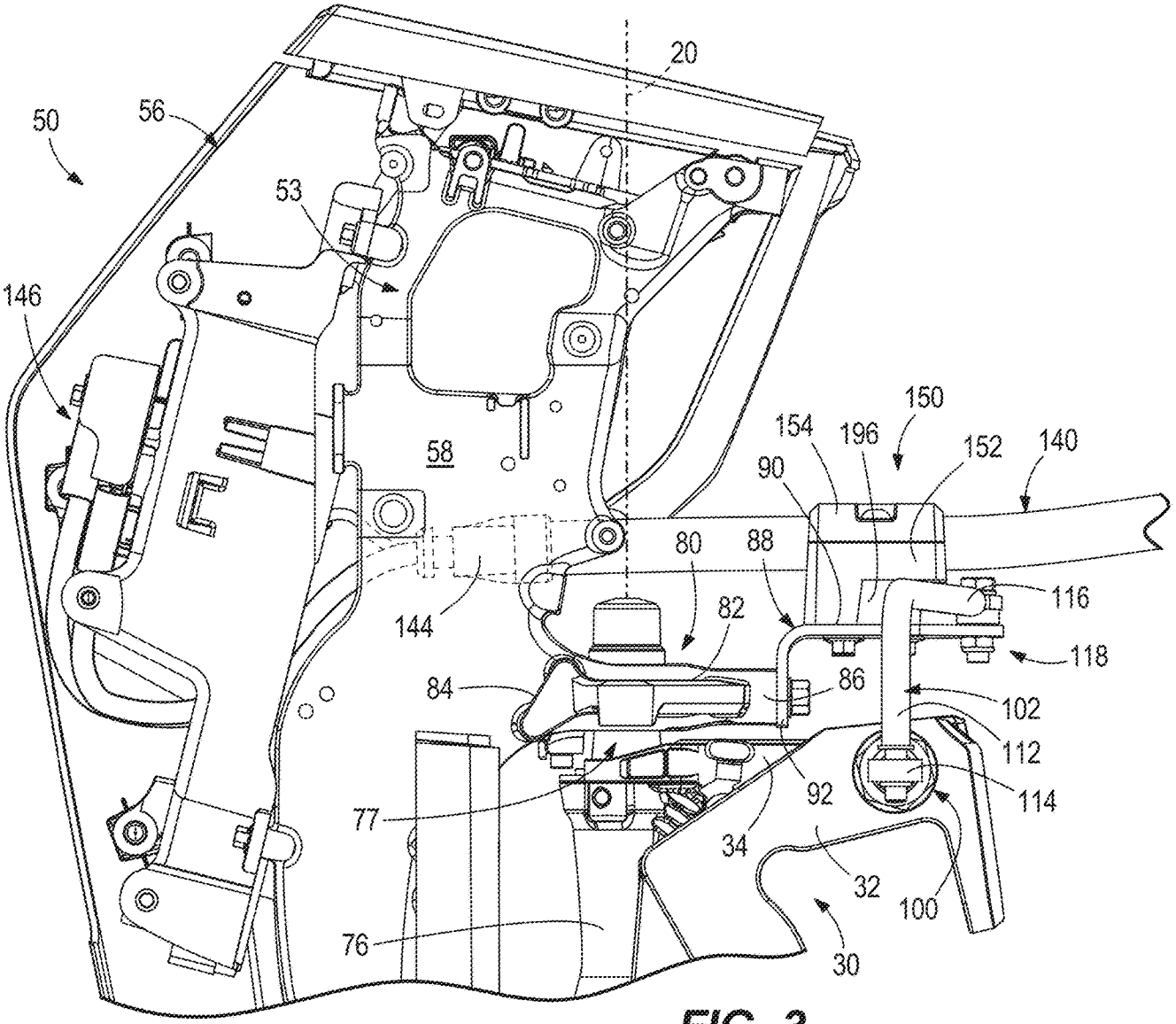
FIG. 3 is a starboard side view of the marine drive of FIG. 2 with a panel of the cowling removed to show the cowling interior.
Figure 7:
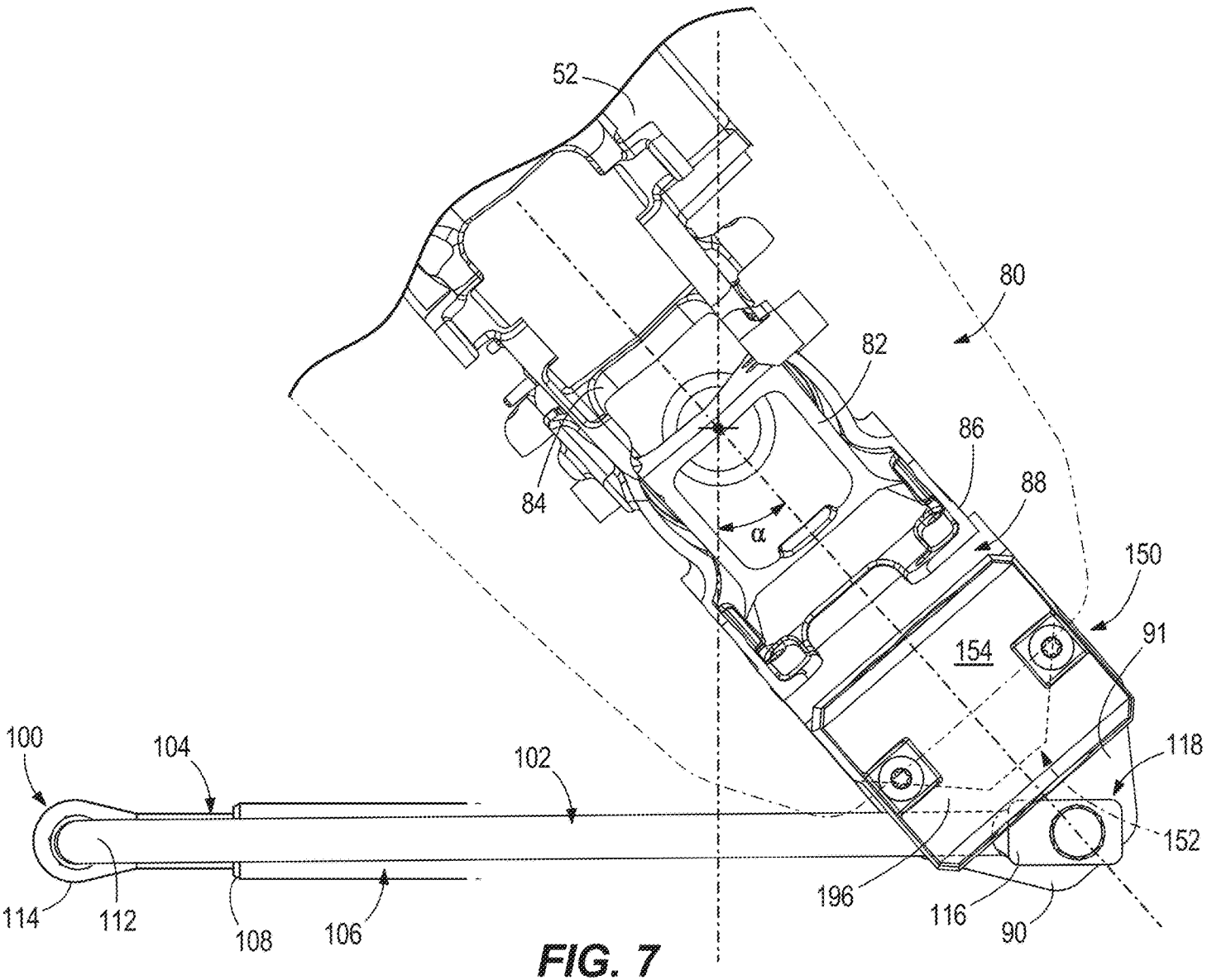
FIG. 7 is a top-down view of the marine drive rotated 45 degrees about the steering axis.

With continued reference to FIGS. 1, 2, and 7, the illustrated steering system 100 is integrated into the transom bracket assembly 30 and includes a steering link 102, a sliding link 104, and a support cylinder 106. The support cylinder 106 extends laterally through the transom bracket assembly 30 from a port-side end 108 to a starboard-side end 110. The sliding link 104 is slidably received in the support cylinder 106 and extends laterally outward from at least one of the port-side end 108 and the starboard-side end 110 of the support cylinder 106. A steering actuator (not shown) is configured to actuate the sliding link to slide laterally within the support cylinder 106. The illustrated steering link 102 is generally L-shaped and couples the sliding link 104 to the steering arm 80. A first end 112 of the steering link 102 is rotatably coupled to a distal end 114 of the sliding link 104 and a second end 116 of the steering link 102 is rotatably coupled to the extension bracket 88 of the steering arm 80 at a pivot joint 118 such that movement of the steering link 102 causes steering movement of the steering arm 80 relative to the steering axis 20. Referring to FIGS. 3 and 4, the illustrated pivot joint 118 includes a fastener 122 that extends through an opening 124 in the second end of the steering link 102 and a corresponding through-bore 126 formed through the support surface 90 of the extension bracket 88 to engage a nut 128, thereby coupling the steering link 102 to the extension bracket 88. A washer 130 may be positioned on the fastener 122 between the nut 128 and the extension bracket 88, between the extension bracket 88 and the steering link 102, and/or between the head of the fastener 122 and the steering link 102.

The steering system 100 is configured to rotate the marine drive 50 about the steering axis 20 by sliding the sliding link 104 laterally within the support cylinder 106, thereby causing lateral movement of the steering link 102 and rotating the marine drive 50. To steer the marine vessel in the starboard direction, the steering actuator slides the sliding link 104 towards the port side of the marine vessel. As the sliding link 104 moves towards the port side, the steering link 102 pushes the steering arm 80 via the pivot joint 118, thereby rotating the marine drive 50 towards the port side of the marine vessel and vectoring the thrust to turn the marine vessel in the starboard direction. To steer the marine vessel in the port direction, the steering actuator slides the sliding link 104 towards the starboard side of the marine vessel. As the sliding link 104 moves towards the starboard side, the steering link 102 pulls the steering arm 80 via the pivot joint 118, thereby rotating the marine drive 50 towards the port side of the marine vessel and vectoring the thrust to turn the marine vessel in the starboard direction.

In the illustrated embodiments, the steering system 100 is configured with a steering link 102 that extends between the extension bracket 88 and a starboard-side end of the sliding link 104. Some embodiments, however, may be configured with a steering link 102 that extends between the extension bracket 88 and a port-side end of the sliding link 104. In such an embodiment, the steering link 102 would pull the steering arm in the port direction and push the steering arm in the starboard direction. The steering actuator may be configured as at least one of a hydraulic actuator, a pneumatic actuator, electric actuators, a wire system (i.e., a steer-by-wire system), and any other type of actuator. Some embodiments may be configured with a different steering arrangement, which may be controlled remotely or manually at the marine drive 50. For example, embodiments of a marine drive 50 can be steered left or right relative to the marine vessel by rotating about the steering axis 20 via a manually operable tiller (not shown) and/or any other known apparatus for steering a marine drive with respect to a marine vessel.

Some embodiments of a marine drive 50 may include at least one flexible rigging connector that extends extending forwardly from the cowling interior 58 (see FIG. 3) to a remote location in the marine vessel. For example, as illustrated in FIGS. 1-3, two rigging connectors 140, 142 are positioned laterally adjacent to each other and extend between the marine drive 50 and the marine vessel. In the illustrated embodiments, the first rigging connector 140 is configured as a power cable that extends from a power source on the marine vessel to a connection terminal 144 of a power entry module 146 within the cowling interior 58. The second flexible rigging connector 142 is configured as a communication cable configured to communicate control signals between the marine drive 50 and the marine vessel, for example in order to control the marine drive 50 and steer the marine vessel. Some embodiments, however, may include a different number of rigging connectors, and at least one of the rigging connectors may be different than those of the illustrated embodiments.

The illustrated marine drive 50 includes a novel a retainer 150 on the steering arm 80 which supports the rigging connectors 140, 142 over the transom bracket assembly 30 and the transom of the marine vessel. The retainer 150 retains the flexible rigging connectors 140, 142 in position relative to the steering arm 80 such that steering of the marine drive 50 about the steering axis 20 also steers the retainer 150 and the flexible rigging connectors 140, 142 about the steering axis 20.

Figure 5:
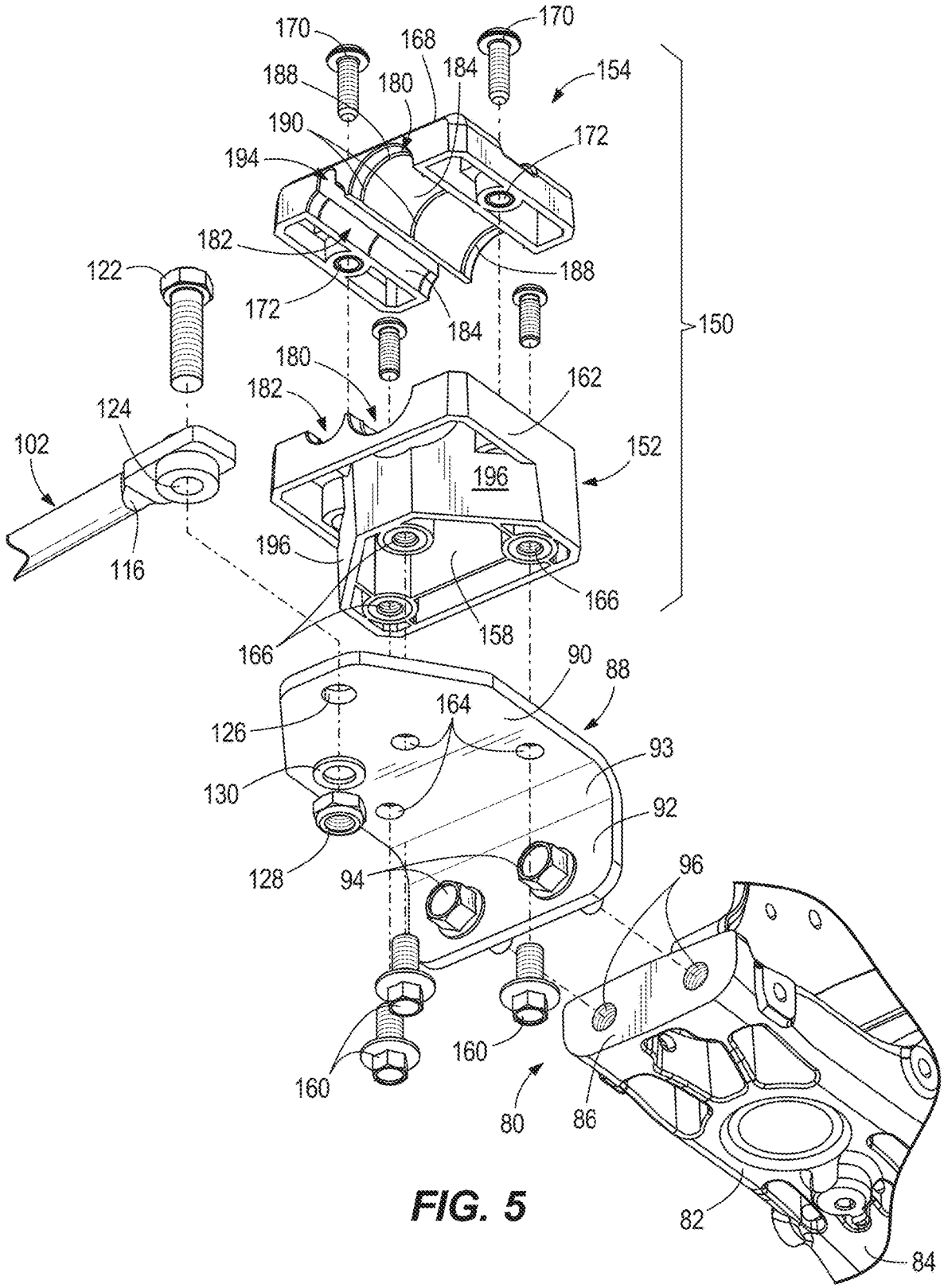
FIG. 5 is another exploded perspective view of the steering arm and retainer of the marine drive of FIG. 4.
Figure 6:
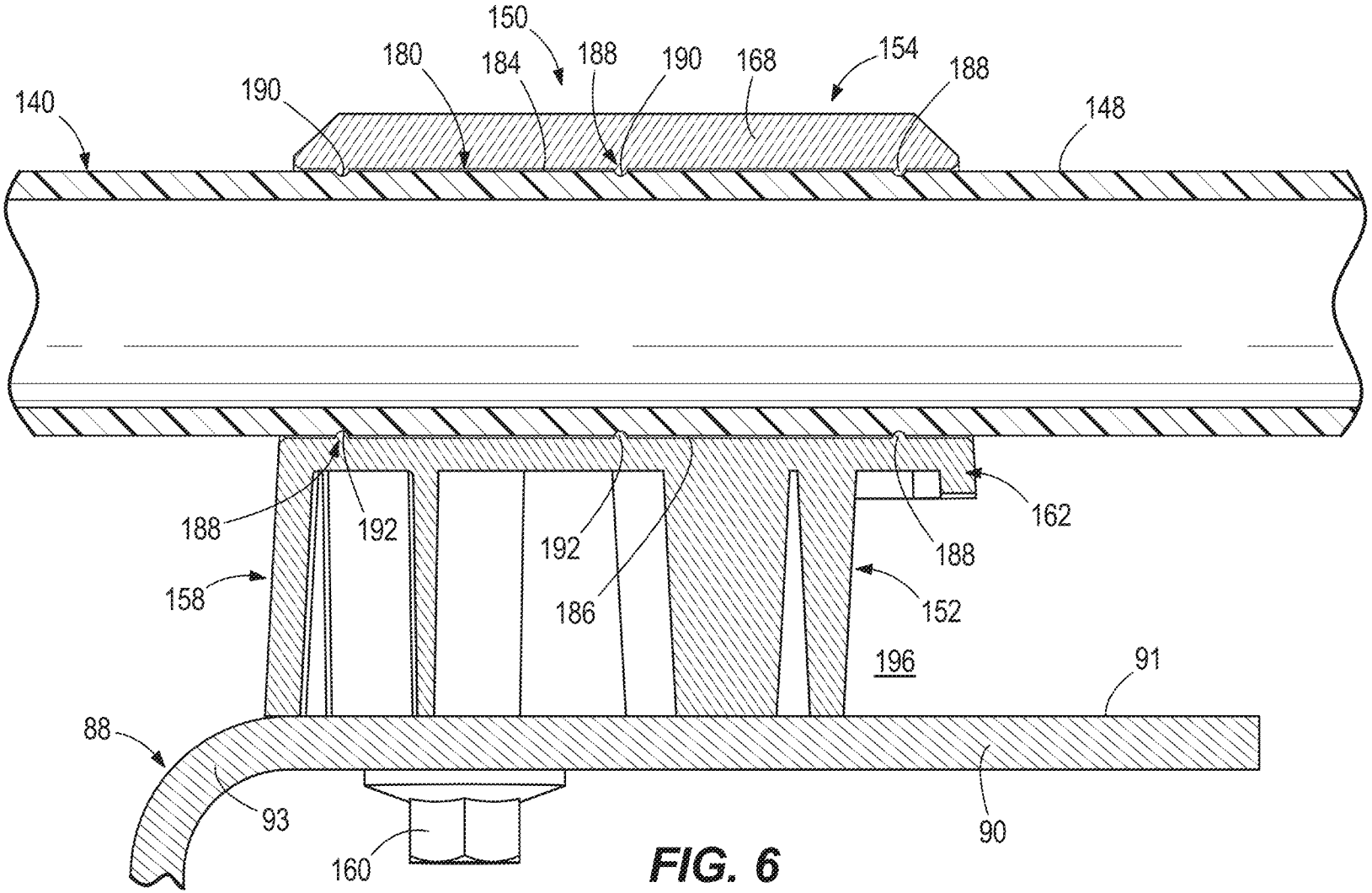
FIG. 6 is a view of section 6-6, taken in FIG. 1.

Referring to FIGS. 4-6, the retainer 150 is coupled to the steering arm 80 and configured to clamp the flexible rigging connectors 140, 142 in place relative to the steering arm 80. Each rigging connector 140, 142 has an outer diameter 148 and the retainer 150 is configured to surround the outer diameters 148. The retainer 150 includes a tray 152 and a cap 154 secured to the top side of the tray 152 in order to clamp the flexible rigging connectors 140, 142 therebetween. The tray 152 includes a body portion 158 that is mounted on a top surface 91 of the extension bracket 88 of the steering arm 80 with fasteners 160 and a tray portion 162 positioned above the body portion 158. In the illustrated embodiments, three fasteners 160 extend through through-bores 164 formed in the supporting surface 90 of the extension bracket 88 to engage corresponding holes 166 formed in the bottom of the tray body portion 158 to secure the tray 152 to the steering arm 80. Some embodiments, however, may include a different number of fasteners, and/or at least one fastener may be in a different location than those of the illustrated embodiments. For example, some embodiments may be configured with a single fastener 160 for securing the retainer 150 to the extension bracket. In such an embodiment, the retainer 150 may be rotatable about an axis formed by the one fastener 160 such that the retainer 150 may rotate with respect to the steering arm 50. This may be useful, for example, to allow the retainer 150 to pivot to maintain an orientation that points the flexible rigging connectors 140, 142 facing towards the marine vessel. The cap 154 has a body 168 and is coupled to the tray 152 by fasteners 170 that extend through through-bores 172 in the cap body 168 to engage corresponding mounting holes 174 in the top side of the tray 152. The illustrated embodiments include two fasteners 170 for coupling the cap 154 to the tray 152. Some embodiments, however, may include a different number of fasteners, at least one of which may be in a different position than those of the illustrated embodiments.

Referring to FIGS. 4-6, the tray 152 and cap 154 of the retainer 150 together define channels 180, 182 through which the flexible rigging connectors 140, 142 extend. A first channel 180 is configured to receive the first rigging connector 140 and a second channel 182 is configured to receive the second rigging connector 142. Each channel 180, 182 includes a top channel portion 184 formed into the body 168 of the cap 154 and a bottom channel portion 186 formed in the tray portion 162 of the tray 152. To secure the rigging connectors 140, 142 in the retainer 150, the first and second rigging connectors 140, 142 can be placed in the bottom channel portion 186 of the first and second channels 180, 182, respectively. The fasteners 170 for coupling the cap 154 to the tray 152 may then be tightened to clamp the rigging connectors 140, 142 in the channels 180, 182 between the cap 154 and the tray 152.

Each channel 180, 182 may include at least one rib 188 that is configured to frictionally engage with the corresponding flexible rigging connector 140, 142 to inhibit axial movement of the flexible rigging connectors 140, 142 relative to the retainer 150. In the illustrated embodiments, for example, each channel 180, 182 includes three ribs 188 that are spaced apart along the axial length of the channel 180, 182 (i.e., along the longitudinal direction LO). Each rib 188 includes a top rib portion 190 formed on a radially inner surface of the top channel portion 184 and a bottom rib portion 192 formed on a radially inner surface of the bottom channel portion 186. When the retainer 150 is assembled, the top and bottom rib portions 190, 192 align to form annular ribs 188 that extend around the radially inner surfaces of the channels 180, 182. As best illustrated in FIG. 6, The annular ribs 188 press into the outer diameters 148 of the rigging connectors 140, 142, thereby forming an interference fit (i.e., frictional engagement) that prevents movement of the rigging connectors 140, 142 in the respective channels 180, 182

As previously mentioned, some embodiments of a marine drive 50 may include a different number of flexible rigging connectors extending from the marine drive 50 to the marine vessel. In such an embodiment, the retainer 150 may include a corresponding channel for retaining each rigging connector. Additionally or alternatively, embodiments of a retainer 150 may include an additional channel for optional or additional rigging connectors or cables. For example, referring to FIGS. 4 and 5, the retainer 150 includes a third channel 194 formed in the cap 154 above the top channel portion 184 of the second channel 182. The third channel 194 is configured as a slot that can receive an additional rigging connector (not shown) in a stacked arrangement above the second rigging connector 142. Other embodiments may include a third channel 194 that is in a different location. For example, a third channel may be formed in the tray 152 below the bottom channel portion 186 of the second rigging connector 142, in the cap 154 or tray 152 above or below the first rigging connector 140, in the cap 154 an/or tray 152 adjacent the first or second channel 180, 182, and/or in any other location in the retainer 150.

In some embodiments, the tray 152 of the retainer 150 may include comprises a cutaway 196 which accommodates pivoting movement of the steering link 102 relative to the rigid steering arm 80. Referring to FIGS. 5 and 7, the illustrated tray 152 includes cutaways 196 configured as chamfered corners of the body portion 158 of the tray 152 that provide clearance for the steering link 102 as the steering link 102 pivots and moves laterally during a turn. The tray portion 162 extends over the cutaway 196 to support the rigging connectors 140, 142 over the pivot joint 118 and the steering link 102. This may be useful, for example, so that the retainer 150 does not obstruct the steering link 102 as the steering system 90 rotates the marine drive 50 towards a maximum steering angle α. For example, as illustrated in FIG. 7, the cutaways 196 allow the marine drive 50 to be rotated to a steering angle α of at least 45 degrees. Some embodiments, however, may be configured with a maximum steering angle α that is greater than 45 degrees or less than 45 degrees.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A marine drive for propelling a marine vessel in water, the marine drive extending from top to bottom in a longitudinal direction, from port side to starboard side in a lateral direction which is perpendicular to the longitudinal direction, and from front to rear in an axial direction which is perpendicular to the longitudinal direction and perpendicular to the lateral direction, the marine drive comprising:

a cowling defining a cowling interior, a steering arm extending forwardly from the marine drive, the steering arm configured for steering of the marine drive about a steering axis, a flexible rigging connector extending forwardly from the cowling interior to a location in the marine vessel, and a retainer coupled to the steering arm which retains the flexible rigging connector in position relative to the steering arm such that steering of the marine drive about the steering axis also steers the retainer and the flexible rigging connector about the steering axis.

2. The marine drive according to claim 1, wherein the retainer is located on top of the steering arm.

3. The marine drive according to claim 1, wherein the retainer clamps the flexible rigging connector in place relative to the steering arm.

4. The marine drive according to claim 1, wherein the retainer comprises a rib frictionally engaged with the flexible rigging connector to inhibit axial movement of the flexible rigging connector relative to the retainer.

5. The marine drive according to claim 1, wherein the flexible rigging connector comprises an outer diameter and wherein the retainer surrounds the outer diameter.

6. The marine drive according to claim 1, wherein the flexible rigging connector extends through the retainer.

7. The marine drive according to claim 1, wherein the steering arm comprises a body which extends forwardly from a supporting frame of the marine drive and an extension bracket which extends forwardly from the body, and wherein the retainer is mounted on the extension bracket.

8. The marine drive according to claim 1, wherein the retainer comprises a tray which is coupled to the steering arm and a cap on the tray, and wherein the flexible rigging connector is clamped between the cap and the tray.

9. The marine drive according to claim 8, wherein the cap is fastened to the tray by a fastener, and wherein fastening the fastener clamps the flexible rigging connector between the cap and the tray.

10. The marine drive according to claim 9, wherein the tray and cap together define a channel through which the flexible rigging connector extends.

11. The marine drive according to claim 10, further comprising a rib in the channel which is frictionally engaged with the flexible rigging connector to inhibit axial movement of the flexible rigging connector relative to the retainer.

12. The marine drive according to claim 11, wherein the rib is an annular rib.

13. The marine drive according to claim 12, wherein the rib is one of a plurality of ribs which are axially spaced apart.

14. The marine drive according to claim 1, further comprising a steering link coupled to the steering arm, wherein movement of the steering link steers the marine drive relative to the steering axis.

15. The marine drive according to claim 14, wherein the steering link is pivotably coupled to the steering arm at a pivot joint such that lateral movement of the steering link causes steering movement of the steering arm relative to the steering axis.

16. The marine drive according to claim 15, wherein the retainer comprises a cutaway which accommodates pivoting movement of the steering link relative to the steering arm.

17. The marine drive according to claim 1, wherein the flexible rigging connector is one of first and second flexible rigging connectors and wherein the retainer retains the first and second flexible rigging connectors in position relative to the steering arm such that steering of the marine drive about the steering axis also steers the retainer and the first and second flexible rigging connectors about the steering axis.

18. The marine drive according to claim 17, wherein the first and second flexible rigging connectors are laterally adjacent to each other.

19. The marine drive according to claim 18, wherein the retainer comprises a tray which is coupled to the steering arm and a cap on the tray, and wherein the first and second flexible rigging connectors are clamped between the cap and the tray.

20. The marine drive according to claim 19, wherein the tray and cap together define first and second channels through which the first and second flexible rigging connectors extend, and further comprising an annular rib in each of the first and second channels which are frictionally engaged with the first and second flexible rigging connectors respectively, to inhibit axial movement of the first and second flexible rigging connectors relative to the retainer.

* * * * *